US007281677B2

(12) United States Patent
Anderson

(10) Patent No.: US 7,281,677 B2
(45) Date of Patent: Oct. 16, 2007

(54) STRIP WINDING MACHINE

(75) Inventor: Martin L. Anderson, Maple Lake, MN (US)

(73) Assignee: National Carpet Equipment, Inc., Minneapolis, MN (US)

( * ) Notice: Subject to any disclaimer, the term of this patent is extended or adjusted under 35 U.S.C. 154(b) by 333 days.

(21) Appl. No.: 11/035,865

(22) Filed: Jan. 10, 2005

(65) Prior Publication Data

US 2006/0151659 A1 Jul. 13, 2006

(51) Int. Cl.
*B65H 23/06* (2006.01)

(52) U.S. Cl. ..... 242/422.2; 242/415.1; 242/394.1; 242/545.1

(58) Field of Classification Search ..... 242/545.1, 242/422.2, 412, 415.1, 394.1, 545; 112/7, 112/137

See application file for complete search history.

(56) References Cited

U.S. PATENT DOCUMENTS 3,721,394 A * 3/1973 Reiser ..... 242/421.3
4,932,600 A * 6/1990 Usui et al. ..... 242/548.4
4,946,115 A * 8/1990 Muller ..... 242/289
4,958,780 A * 9/1990 Bruenn et al. ..... 242/486.8
5,028,012 A * 7/1991 Kita ..... 242/548.4
5,524,834 A * 6/1996 Bogucki-Land ..... 242/421.8
5,992,791 A * 11/1999 Tsuda et al. ..... 242/535.3
6,027,066 A * 2/2000 Street ..... 242/532.5
6,585,181 B2 * 7/2003 Kronenberger ..... 242/129.8
6,691,945 B2 * 2/2004 Slezak ..... 242/564
6,702,221 B2 * 3/2004 Haber et al. ..... 242/421.4
6,786,445 B1 * 9/2004 Todd et al. ..... 242/548.2
2004/0000608 A1 * 1/2004 Metza ..... 242/420

OTHER PUBLICATIONS

Warner Electric Brochure, P-1313 Apr. 2003 "Clutch/Brake Permanent Magnet and Magnetic Particle Clut6ches and Brakes".

* cited by examiner

*Primary Examiner*—Peter M. Cuomo
*Assistant Examiner*—Sang Kim
(74) *Attorney, Agent, or Firm*—Steven E. Kahm; Nikolai & Mersereau, P.A.

(57) ABSTRACT

A take-up roll forming apparatus for flexible strip material comprises a motor-driven shaft journaled for rotation on a frame where the shaft extends through a circular plate that is affixed to the shaft. A plurality of magnets is affixed to the plate in a predetermined pattern. A reel having a tubular core is adapted to slip over the motor-driven shaft and the reel also includes a circular end plate having magnets affixed thereto such that when the motor-driven shaft rotates, it tends to carry the reel with it due to the magnetic forces attracting the magnets on the motor-driven plate to the magnets on the end plate of the reel. As the strip material being wound accumulates on the reel, and the effective diameter of the roll of strip material increases to the point where the supply source cannot keep up with the speed at which the strip material is accumulating on the reel, a tension develops in the strip sufficient to overcome the magnetic attraction forces, such that the reel slips relative to the motor-driven shaft to accommodate the speed differential.

12 Claims, 5 Drawing Sheets

STRIP WINDING MACHINE

BACKGROUND OF THE INVENTION

I. Field of the Invention

This invention relates generally to winding and reeling apparatus, and particularly to an apparatus for winding strip material onto a spool or reel where the rotational velocity of the spool or reel can vary to accommodate a constant feed rate of the strip material.

II. Discussion of the Prior Art

In handling continuous, long lengths of flexible strip material, it is frequently desirable to package quantities thereof in a rolled form. In creating a roll, the strip material is drawn onto to a motor-driven reel or spool from a supply source. If the feed rate of the strip material from the supply source remains fairly constant, provision must be made for changing the speed at which the take-up reel or spool is driven to accommodate the increasing radius of the spooled strip material as the material builds up on the spool.

In prior art systems, expensive electronic servo control loops are frequently used in combination with the reel drive motor to control the speed of the take-up reel drive motor, slowing it down as the effective radius of the spooled strip material increases.

As an example, carpeting is often cut into four-inch wide strips where the strips of carpeting are intended for later use as a base applied to room walls at their intersection with a carpeted floor. Once the carpeting is cut into base strips, the edges thereof must be basted to prevent fraying. A basting strip is sewn to one edge of the carpet strip, using an electric sewing machine. The sewing machine, of course, operates at a generally constant speed as it feeds the basting tape and carpeting strip beneath the reciprocating needle.

The carpet base material is generally sold in 50-foot lengths and is wound as a coil. In the past, to effect winding of carpet base leaving the sewing station, the operation has either been performed manually or through the use of a motor-driven reel whose speed is automatically varied to match the feed rate through the sewing machine as the material builds up on the reel. The motor control circuit commonly includes a suitable sensor for measuring tension and circuitry coupled to the sensor for adjusting the speed of the take-up motor to maintain a relatively constant tension. Alternatively, the carpet strip may be made to form a U-shaped loop between the sewing machine and the take-up reel and a sensor is used to monitor the loop position. The sensor output is then used to vary the speed of the take-up reel motor so that the bottom of the loop remains relatively fixed in position assuring that there will be slake in the strip between the sewing machine and the take-up reel.

There is a need for a simpler, less expensive apparatus for winding up rolls of strip material in a way that adjusts the relative speed of the take-up reel to match the increase in rolled diameter as the strip material builds up on the reel or spool. The present invention provides such a solution.

SUMMARY OF THE INVENTION

The present invention comprises a take-up roller apparatus for flexible strip material that is being fed from a supply source at a predetermined, generally constant rate. The apparatus includes a frame having a motor-driven shaft journaled for rotation thereon. This shaft has a plate affixed to it and the plate supports a plurality of magnets thereon that are arranged in a concentric pattern relative to the shaft. A take-up spool comprises at least one flange affixed to one end of a tubular shaft. The tubular shaft is adapted to slip over the aforementioned motor-driven shaft and has its flange in sufficiently close proximity to the plate carrying the magnets that it is under the attractive influence of the magnets. When tension in the strip exceeds the attractive force provided by the magnets, the take-up spool slips relative to the motor-driven shaft. This allows the take-up spool to rotate about the motor-driven shaft, but with the speed of rotation of the take-up spool varying to accommodate the feed rate of the supply and a changing radius of the strip material as it winds upon the tubular shaft of the take-up spool.

DESCRIPTION OF THE DRAWINGS

The foregoing features, objects and advantages of the invention will become apparent to those skilled in the art from the following detailed description of a preferred embodiment, especially when considered in conjunction with the accompanying drawings in which numerals in the several views refer to corresponding parts.

DESCRIPTION OF THE PREFERRED EMBODIMENT

Figure 1:
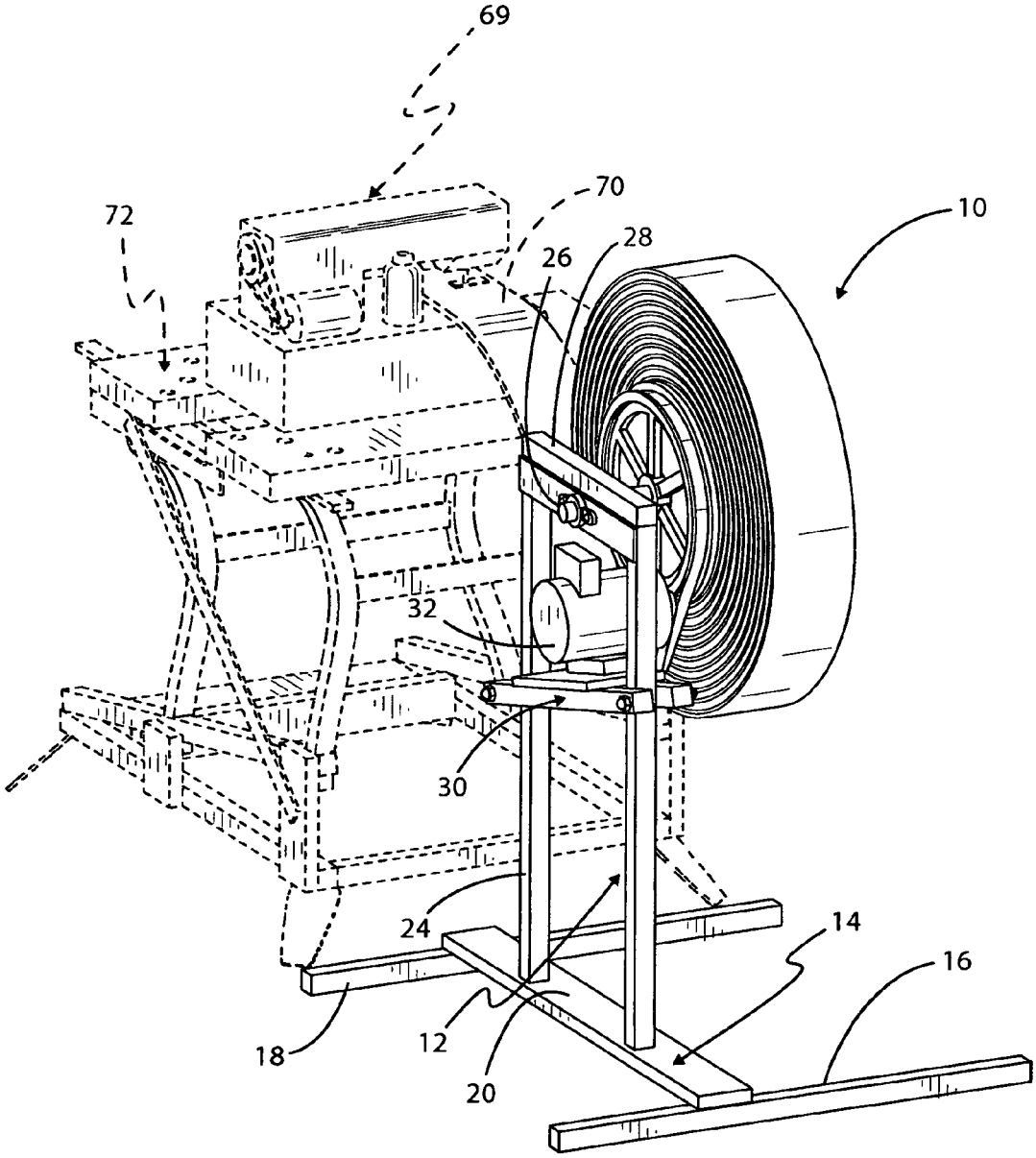
FIG. 1 is a perspective view of a preferred embodiment of the take-up roller apparatus.

Certain terminology will be used in the following description for convenience in reference only and will not be limiting. The words "upwardly", "downwardly", "rightwardly" and "leftwardly" will refer to directions in the drawings to which reference is made. The words "inwardly" and "outwardly" will refer to directions toward and away from, respectively, the geometric center of the device and associated parts thereof. Said terminology will include the words above specifically mentioned, derivatives thereof and words of similar import.

Referring first to FIG. 1, there is shown a perspective view of a prototype of the strip winding machine constructed in accordance with the present invention. It is indicated generally by numeral 10 and is seen to include a frame 12 having a base 14 including elongated parallel foot members 16 and 18 and a cross member 20. The cross member 20 may be welded, bolted or otherwise affixed to the foot members 16 and 18. Rising perpendicularly from the cross member 20 is a pair of vertical struts 22 and 24. Extending between the upper ends of the vertical struts 22 and 24 is a bearing plate 26 and a top member 28 that serves to maintain the vertical struts 22 and 24 in a parallel, spaced-apart relationship. The frame 12 illustrated is only one way of supporting the take-up roller and those skilled in the art can readily implement alternative arrangements.

The frame 12 further includes a motor mount structure 30 that is clamped or otherwise affixed to the vertical struts 22 and 24 at a location between the cross member 20 and the bearing plate 26.

Figure 3:
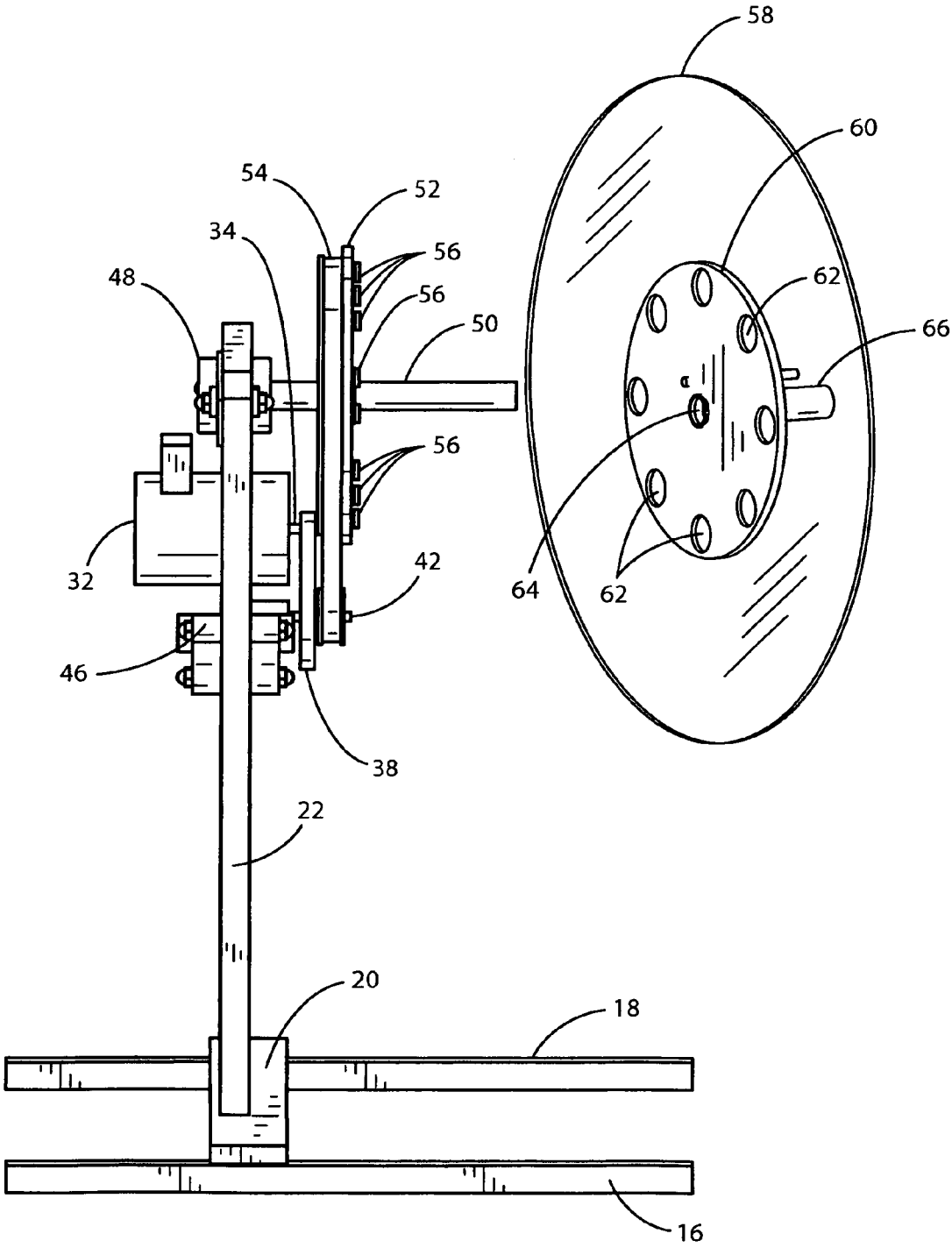
FIG. 3 is a side view of the take-up roller apparatus with the take-up spool separated from the motor-driven shaft.
Figure 4:
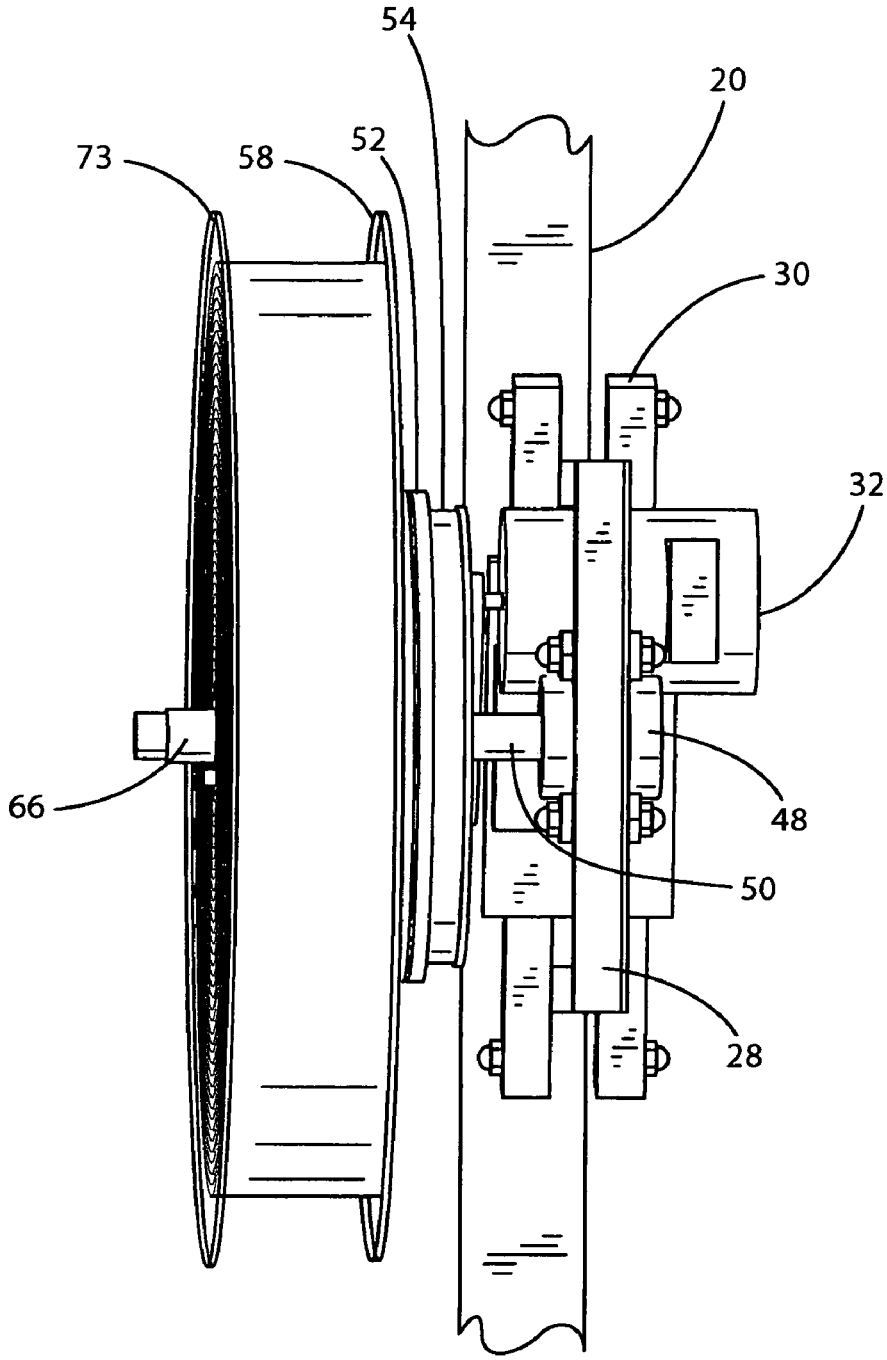
FIG. 4 is a partial side view with the take-up spool in place.
Figure 5:
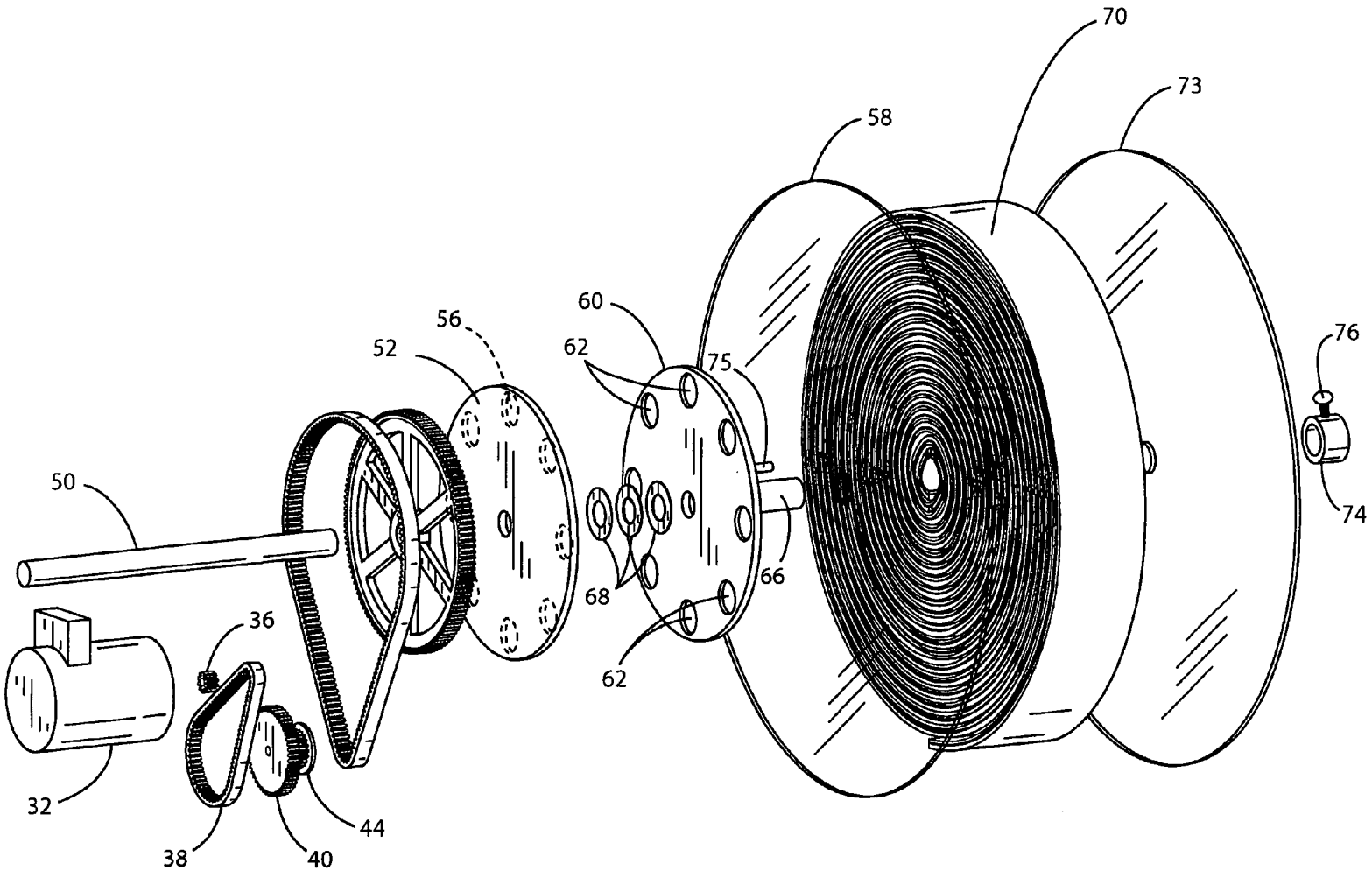
FIG. 5 is an exploded view of the strip winding machine.

With reference to FIGS. 3 and 5, the motor 32 has an output shaft 34 supporting a pulley 36 (FIG. 5) over which an endless belt 38 is entrained. The belt 38 also surrounds a pulley 40 that is mounted on a common shaft 42 with a smaller diameter pulley 44. The shaft 42 is a stub shaft that is journaled for rotation in bearings contained within a bearing block 46 attached to the motor mount assembly 30.

A further bearing block 48 is mounted in the bearing plate 26 and it journals a shaft 50 to which a large diameter pulley 52 is affixed. An endless belt 54 is entrained about the pulley 52 and the pulley 44. Because of the relative diameters of the pulleys 36, 40, 44 and 52, a significant speed reduction of the shaft 50 relative to the shaft 34 results. For example, and without limitation, the sizes of the several pulleys may be such that the motor shaft 34 rotates at 1750 rpm while the shaft 50 rotates at 100 rpm.

Figure 2:
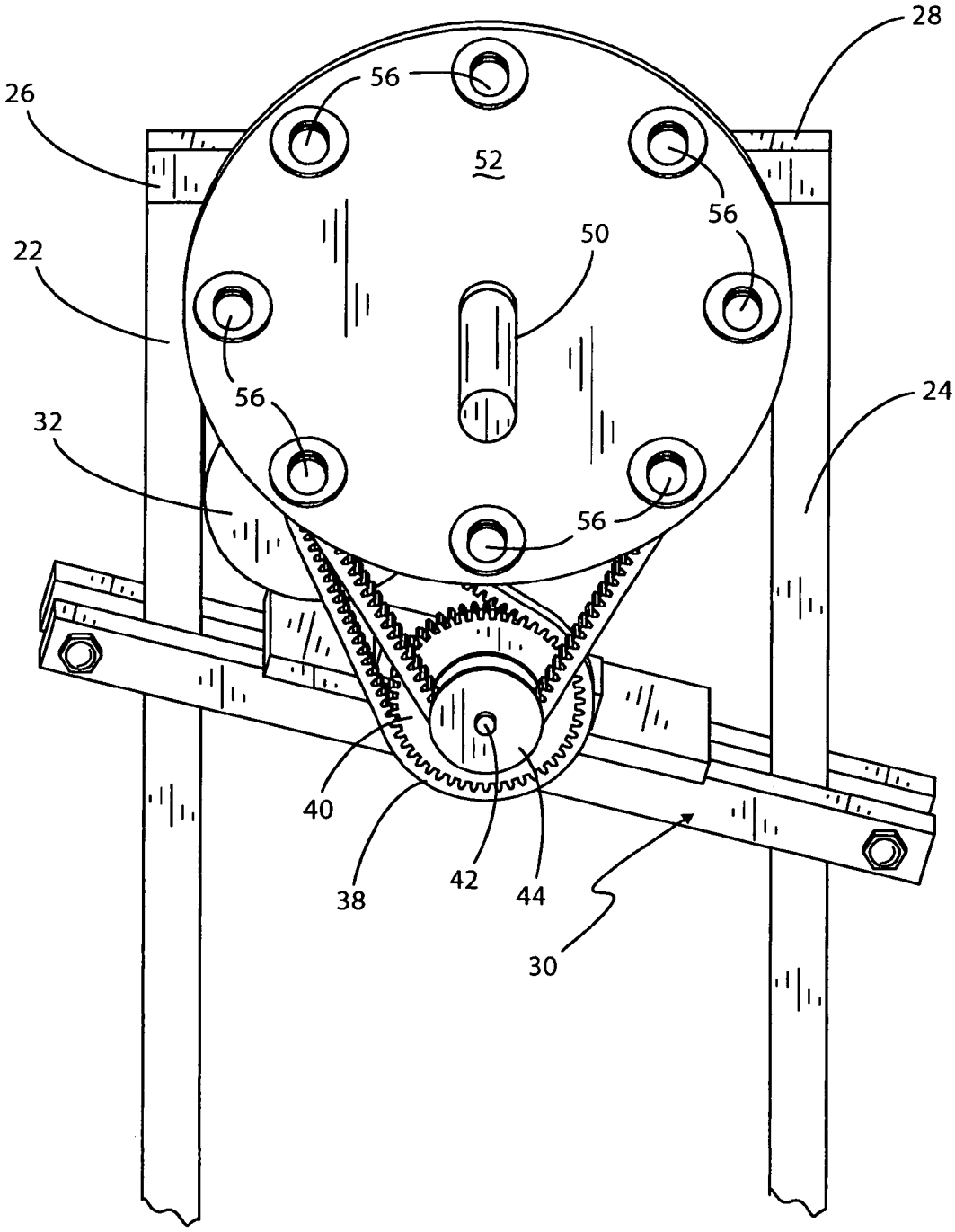
FIG. 2 is a front elevation of the apparatus with the take-up spool removed.

With reference to FIG. 2, there is shown a plurality of small, round permanent magnets 56 are affixed to the pulley 52 in a generally equally spaced circumferential relationship just inward of the periphery thereof.

In FIG. 3 there is shown a large diameter circular disk 58 of clear plastic and concentrically disposed on the large diameter disk 58 is a circular plate 60 that also supports a plurality of permanent magnets 62. The circular plate 60 has a central opening 64 formed therethrough and aligned with this central opening is a tubular shaft 66 whose inside diameter is only slightly larger than the outside diameter of the shaft 50. Bearings (not shown) are provided at opposed ends of the tubular shaft 66. The permanent magnets 62 are radially disposed from the central opening 64 equidistant to the radial displacement of the permanent magnets 56 on the pulley 52. Thus, when the shaft 50 is inserted through the bearings in opening 64 and through the tubular shaft 66, the magnets on the faces of disks 52 and 60 are aligned such that the disk 58 is magnetically attracted to or repelled by the magnets on the pulley 52 depending upon the relative polarities of the magnets on the disk 52 relative to those on disk 60. A slight gap is maintained between the two by a series of thrust washers and bearings 68.

Referring again to FIG. 1, the strip winding machine of the present invention is shown as being associated with a strip supply, here shown as a sewing machine indicated generally by numeral 69. For purposes of illustration only, the sewing machine may be used to affix a basting strip to a strip of carpeting 70. The sewing machine is shown as being mounted on a portable workbench 72 of the type that is commercially available from the Black & Decker Corporation, however, other strands can just as well be used. The carpet strip 70 is cut from a carpet roll and may be approximately 4 in. in width when the strip 70 is to be used as base molding in a room having a carpeted floor. The basting strip material sewn to one edge of the carpet strip 70 is used to prevent unraveling of the cut carpet yarns and to improve the overall appearance.

The feed dogs or rollers of the sewing machine 69 advance the carpet strip at a relatively constant speed while the motor 32 rotates the pulley 52 also at a constant speed. However, the take-up reel, including the disk 58, the tubular shaft 66 and the end plate 73 must be allowed to rotate at a variable rate to accommodate the build-up of carpet strip material on the reel. As the effective diameter of the strip material increases, the reel must slow down to match the speed at which the feed dogs of the sewing machine are advancing the bound strip material.

Because the reel assembly is only magnetically coupled to the motor-driven pulley 52, tension between the carpet strip leaving the sewing machine and the take-up reel is able to overcome the magnetic attractive force between the reel assembly and the motor-driven pulley 52 so that the reel can slip to match the rate at which the strip material is being fed from the sewing machine. The attractive force between the drive plate 52 and the driven plate 60 can be adjusted by changing the spacing therebetween using a greater or fewer number of washers as spacers.

In use, a length of the strip material 70 is fed from the sewing machine 69 and wedged between the outer diameter of the tubular shaft 66 and a retainer pin 75 that is affixed to the plate 60 and extends parallel to the tubular shaft 66, as best seen in FIG. 5. The end plate 73, whose diameter is the same as that of the plate 58, is affixed to the end of the tubular shaft 66 by a collar 74 that is adapted to be held in place by a thumbscrew 76. With the sewing machine running, the motor 32 is turned on to drive the pulley 52 carrying the magnets 56. Because of the close spacing between the magnets 56 on the pulley 52 and the magnets 62 on the plate 60, the reel or spool assembly will rotate with the pulley 52 due to the magnetic attraction. However, as the diameter of the roll of strip material 70 being wound on the reel increases, a point is reached where the reel assembly must move at a continuously decreasing angular rate, given the fact that the sewing machine feed dogs operate at a constant rate. Tension forces build up in the strip material exiting the sewing machine to the point where the magnetic attraction between the pulley 52 and the reel plate 60 is overcome and the tubular shaft 66 will slip relative to the motor-driven shaft 50 that it surrounds. Thus, the reel assembly will move at a rate allowed by the sewing machine feed dogs even though the motor 32 is driving the pulley 52 and the shaft 50 at a rate that may be substantially in excess of the rotational speed of the reel upon which the roll of carpeting is being formed.

As the plate 60 slips relative to plate 52, heat is generated by the changing magnetic field. By using a thermally conductive material, e.g., aluminum for the plates, and sufficient spacing between magnets, this heat is carried away from the magnets, preventing overheating and possible demagnetization of the magnets.

After a predetermined length of bound carpet strip is formed on the roll, the web leading to the roll is cut and the motor 32 is turned off. The end plate 73 can then be removed and the roll of carpet strip can be pulled free of the shaft 66. The severed end of the strip coming from the sewing machine will again be wedged between the shaft 66 and the retainer pin 72 with the plate 73 being fastened onto the end of the tubular shaft 66. The motor 32 is again turned on to begin forming a further roll of strip material.

While the exemplary embodiment described herein is designed for use in winding carpet base material, it is to be appreciated that devices constructed in accordance with the present may be used in various applications where it is desired to create a roll of flexible strip material that is being fed from a supply source at a generally fixed rate.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself

What is claimed is:

1. A take-up roller apparatus for flexible strip material being fed from a supply at a predetermined rate comprising:

(a) a frame;

(b) a first shaft journaled for rotation on said frame;

(c) a motor coupled in driving relation to said first shaft for rotating the first shaft at a generally constant speed;

(d) a plate mounted on the first shaft for rotation therewith, said plate supporting a first plurality of permanent magnets thereon; and (e) a take-up spool comprising a first flange affixed to a tubular shaft proximate a first end thereof, the flange having a plurality of permanent magnets thereon which are generally aligned with the plurality of magnets on the plate, the tubular shaft adapted to be journaled for rotation about and in surrounding relation to the first shaft with the first flange located in sufficiently close proximity to said plate such that the magnets are under the influence of each other whereby the take-up spool rotates about the first shaft allowing the strip material to be wound about the tubular shaft of the take-up spool with the speed of rotation of the take-up spool varying to accommodate the feed rate of the supply and a changing radius of the strip material as it winds upon the tubular shaft of the take-up spool.

2. The take-up roller apparatus as in claim 1 and further including:

(a) a second flange adapted to be removably secured to a second end of the tubular shaft.

3. The take-up roller apparatus as in claim 1 wherein the strip material is carpet base and the supply comprises a sewing machine for affixing basting tape to the carpet base.

4. The take-up roller apparatus as in claim 1 wherein the plate and the first flange are in close but non-contact parallel relation when the take-up spool is mounted on the first shaft.

5. The take-up roller as in claim 1 wherein the first and second plurality of magnets are permanent magnets.

6. The take-up roller as in claim 1 wherein the motor is coupled in driving relation to the first shaft through a belt and sheave connection.

7. The take-up roller as in claim 1 wherein, the magnets have the like poles facing each other on the plates and the flanges.

8. The take-up roller as in claim 1 wherein, the magnets have the opposite poles facing each other on the plates and the flanges.

9. The take-up roller as in claim 1 wherein, the magnets on the plate or flange are uniformly spaced around a circumference of a circle at the same radius form the axis of rotation of the plate.

10. The take-up roller as in claim 1 wherein, the magnets on the plate or flange are variably angularly spaced around a circumference of a circle at the same radius form the axis of rotation of the plate.

11. The take-up roller as in claim 1 wherein, the magnets on the plate or flange are uniformly spaced at selected angles around the axis of rotation of the plate and have variable radii.

12. The take-up roller as in claim 1 wherein, the magnets on the plate or flange are variably spaced at selected angles around the axis of rotation of the plate and have variable radii.

* * * * *